United States Patent [19]

Tschentscher

[11] Patent Number: 4,787,565

[45] Date of Patent: Nov. 29, 1988

[54] METHOD AND ASSEMBLY FOR FORMING THREAD RESERVE ON SPOOL TUBE IN THREAD WINDING APPARATUS

[75] Inventor: Alfred Tschentscher, Cologne, Fed. Rep. of Germany

[73] Assignee: FMN Schuster GmbH & KG, Hürth, Fed. Rep. of Germany

[21] Appl. No.: 21,236

[22] Filed: Mar. 3, 1987

[30] Foreign Application Priority Data

Mar. 6, 1986 [DE] Fed. Rep. of Germany ..... 3607342

[51] Int. Cl.[4] ..... B65H 54/02; B65H 54/34

[52] U.S. Cl. ..... 242/18 PW

[58] Field of Search ..... 242/18 PW, 18 R; 57/299

[56] References Cited

U.S. PATENT DOCUMENTS

| | | | |
|---|---|---|---|
| 3,275,252 | 9/1966 | Bolger | 242/18 PW |
| 3,385,532 | 5/1968 | Sparling | 242/18 PW |
| 3,814,341 | 6/1974 | Dickson, III et al. | 242/18 PW X |
| 3,858,816 | 1/1975 | Corbiere | 242/18 PW |
| 3,960,336 | 6/1976 | Tschentscher | 242/18 PW |
| 4,019,690 | 4/1977 | Peter et al. | 242/18 PW X |
| 4,093,135 | 6/1978 | Hermanns | 242/18 PW |
| 4,094,471 | 6/1978 | Tschentscher | 242/18 PW |
| 4,154,409 | 5/1979 | Reisser et al. | 242/18 PW |
| 4,195,788 | 4/1980 | Miyazaki et al. | 242/18 PW |
| 4,634,064 | 1/1987 | Burkhard et al. | 242/18 PW |
| 4,641,793 | 2/1987 | Flueli et al. | 242/18 PW |
| 4,662,574 | 5/1987 | Slavik et al. | 242/18 PW |

FOREIGN PATENT DOCUMENTS

| | | | |
|---|---|---|---|
| 0124962 | 11/1984 | European Pat. Off. | 242/18 PW |
| 2351039 | 4/1975 | Fed. Rep. of Germany | 242/18 PW |

*Primary Examiner*—Stanley N. Gilreath

*Attorney, Agent, or Firm*—Neil F. Markva

[57] ABSTRACT

A method and assembly are for forming a thread reserve when winding a thread onto spool tube in a thread winding apparatus having a spool pin, a pressure roller and reverse thread roller device. The spool tube is carried by the spool pin and rotatably driven by a motor. The spool tube is capable of being swung in a direction toward the pressure roller. The spool tube has a smooth peripheral surface at least in the area of the thread reserve winding. A thread blocking device is disposed at an entry end of the pressure roller and holds back the thread from being introduced to the reverse thread roller device until the thread reserve winding has been wound onto the spool tube. A thread directing mechanism moves an incoming thread back-and-forth over a length of the spool tube defining the breadth of the thread reserve winding being formed. The thread directing mechanism is located ahead of the spool tube when viewing the assembly in the direction of the course of the thread through the thread winding apparatus. The incoming thread is introduced in front of the thread blocking device and into the thread directing mechanism before the pressure roller is in peripheral contact with the spool tube. The incoming thread is wound around the smooth surface of the rotating spool tube while being moved back-and-forth by the thread directing mechanism. The end portion of the thread is then cut to separate it before the pressure roller contacts the spool tube.

14 Claims, 3 Drawing Sheets

FIG. 4
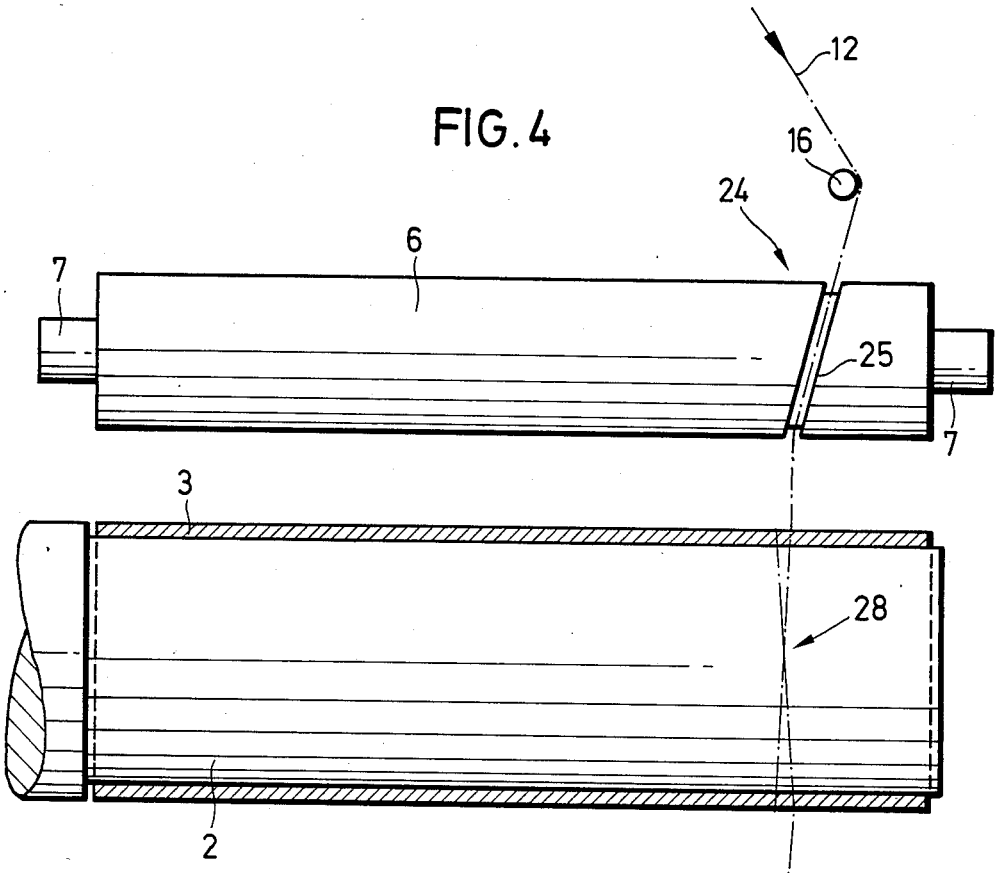
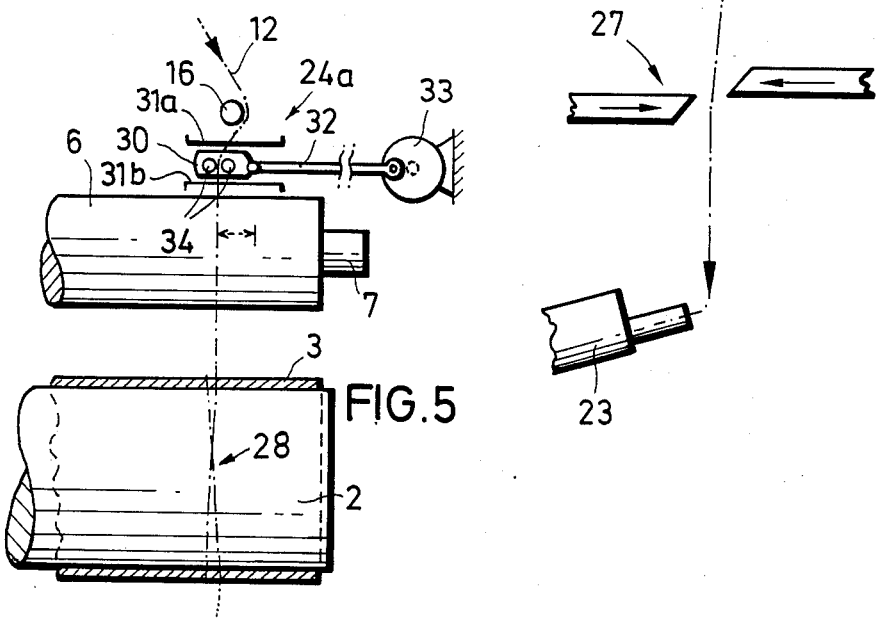
FIG. 5

METHOD AND ASSEMBLY FOR FORMING THREAD RESERVE ON SPOOL TUBE IN THREAD WINDING APPARATUS

FIELD OF INVENTION

This invention relates to forming a thread reserve winding onto a smooth peripheral surface of a spool tube. More particularly, the invention is directed to a method and assembly for forming a thread reserve winding on a spool tube in a thread winding apparatus having a spool pin, a pressure roller and reverse thread roller device before the thread is introduced into the reverse thread roller device.

BACKGROUND OF THE INVENTION

Precision thread winding machines having a spool pin, a pressure roller and reverse thread roller device are well known. Such machines are driven with spindles with the spool pin carrying a spool tube and the reverse thread roller being driven jointly with the spool pin by a motor.

In such a known thread winding apparatus, it is usual to insert the thread with a hand injector such as a suction pistol. The end of the thread is grasped by the suction pistol and simply placed into a notched groove found on the spool tube to thereby clamp the end of the thread in place on the surface of the spool tube. The thread is then cut through to separate it from the suction pistol once it has been clamped in place on the spool tube surface.

In one known configuration, the spool tube and the pin carrying the spool tube have catch slots on the front side thereof. The so-called catch slots make it possible to connect the thread with the spool tube for the purpose of carrying out the rest of the winding.

The winding-up process on the spool tube takes place in a very well known manner once a so-called reserve winding is formed. The reserve winding makes it possible to connect the start of the ready-wound spool with the end of a further spool so that the spooling of several thread rolls can be undertaken without interruption. In other words, the thread reserve winding provides a length of the thread as a lead for interconnecting separate spools being wound on the prior art winding machines.

Under special circumstances, such as at high rotational speeds of, for example, approximately 600 meters per minute or even with threads which exceed a certain thickness, disadvantages develop when winding onto the spool tube. The notched groove is more or less cracked open through the developing draw of the thread in the depth. The catch slots located at the front of spool tube are damaged or deformed so that a catching action is no longer guaranteed. The spool tubes must be exchanged because of deformation of the catch elements after a short period of time or performance.

PURPOSE OF THE INVENTION

The primary object of the invention is to make it possible to spool a thread onto a spool tube even under special circumstances in such a way that the previous difficulties cannot develop and perfect thread spooling is guaranteed even at higher speeds and with threads of greater thickness.

Another object of the invention is to provide a method and an assembly for forming a thread reserve winding on a spool tube having a smooth peripheral surface at least in the area of the reserve winding.

A further object of the invention is to provide a method and an assembly for feeding the incoming thread onto a smooth peripheral surface of a spool tube in a manner to automatically fix and hold fast the thread layers without direct clamping of the end of the thread by a catch groove or catch slots.

A still further object of the invention is to provide a method and assembly for automatically securing a thread reserve winding onto a smooth spool tube using a to-and-fro movement over a delimited length of the pressure roller. Thus, the thread lying at the top of the reserve winding covers the reserve winding already formed from one side to the other and holds fast the threads lying underneath without additional clamping or catching action being required.

A still further object of the invention is to provide a means for guiding the incoming thread in a to-and-fro manner along the length of a smooth peripheral surface on the spool tube so that the reserve winding is held together and fixed on the spool tube while requiring no restrictions to the observance of several thread strengths and spool speeds.

SUMMARY OF THE INVENTION

The assembly of the invention comprises a spool tube carried by the spool pin and rotatably driven by a motor. The spool and pin combination is capable of being swung in a direction toward the pressure roller of the thread winding apparatus. The spool tube has a smooth peripheral surface at least in the area of the thread reserve winding.

Thread directing means is provided for directing an incoming thread to-and-fro over a length of a spool tube defining the breadth of the thread reserve winding being formed along the smooth peripheral surface. The thread directing means is located ahead of the spool tube when viewing the assembly in the direction of the course of the thread through the thread winding apparatus.

A thread blocking device is disposed at an entry end of the pressure roller for holding back the thread from being introduced to the reverse thread roller device until the thread reserve winding is formed on the smooth surface of the spool tube.

In a first embodiment of the thread directing means, an oblique channel is disposed in the pressure roller of the thread winding apparatus. The oblique channel is closed in itself and, with a corresponding turn of the pressure roller, causes a lateral movement of the thread in the area of the reserve winding to be formed. Each time the thread moves back-and-forth, the windings of the roll lying underneath are covered obliquely by the thread newly arriving and lying on top of the next previously winding of the thread. This causes the reserve winding to be held together in a corresponding manner on the spool tube with the thread being drawn off compulsorily from the feed through the turning of the spool tube.

In another embodiment of the thread directing means, a slide mechanism is located adjacent the pressure roller for moving the incoming thread back-and-forth along a delimited length of the pressure roller. In a specific embodiment, the slide mechanism includes means for moving a slide member back-and-forth within slide member guiding means. The slide member includes thread engaging means which engage the incoming thread while the thread reserve winding is being formed as the slide member moves back-and-forth.

The thread engaging means includes a passageway through which the incoming thread moves from the thread blocking device past the pressure roller onto the spool tube. In a specific embodiment of the thread engaging means, two pins are laterally disposed with respect to each other on the slide member to define the passageway therebetween.

A thread cutting device is disposed adjacent the thread winding apparatus to separate an end portion of the incoming thread once the thread has been secured on the spool tube. The thread cutting device can advantageously be arranged in the housing surrounding the thread winding apparatus which includes the pressure roller, the reverse thread roller device and the spool pin which carries the spool tube toward the pressure roller.

Another feature of the invention is directed to the method for forming a thread reserve winding when spooling a thread onto a spool tube. An end of the incoming thread is grasped by a thread injector device such as a hand-operated, suction pistol to guide the thread. Once grasped, the incoming thread is introduced in front of the thread blocking device and into the thread directing means before the pressure roller is in peripheral contact with the spool tube. The incoming thread is then allowed to wind around the smooth surface of the rotating spool tube while being moved back-and-forth by the thread directing means. An end portion is cut from the thread before the pressure roller contacts the spool tube and, upon completion of the thread reserve winding, releases the thread from the thread blocking device to allow the thread to be introduced into the reverse thread roller device.

Therefore, in accordance with the present invention, the reserve winding is set up with constant to-and-fro movement of the thread during the formation of the thread reserve winding while the thread is being drawn off automatically from the feedpoint. As soon as the thread reserve winding has reached a predetermined periphery, the blocking pin or device is released such as being drawn back to a retracted position. The thread, fed into the thread directing means in the first instance, is then taken over by the reverse thread roller changing device and the set up of the precision winding apparatus on the driven spool tube automatically ensues.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 4 is a diagrammatic, side elevational view of the device as shown in FIG. 3; and FIG. 5 is a fragmentary, side elevational view of another embodiment of a device made in accordance with the invention.

DETAILED DESCRIPTION

Figure 1:
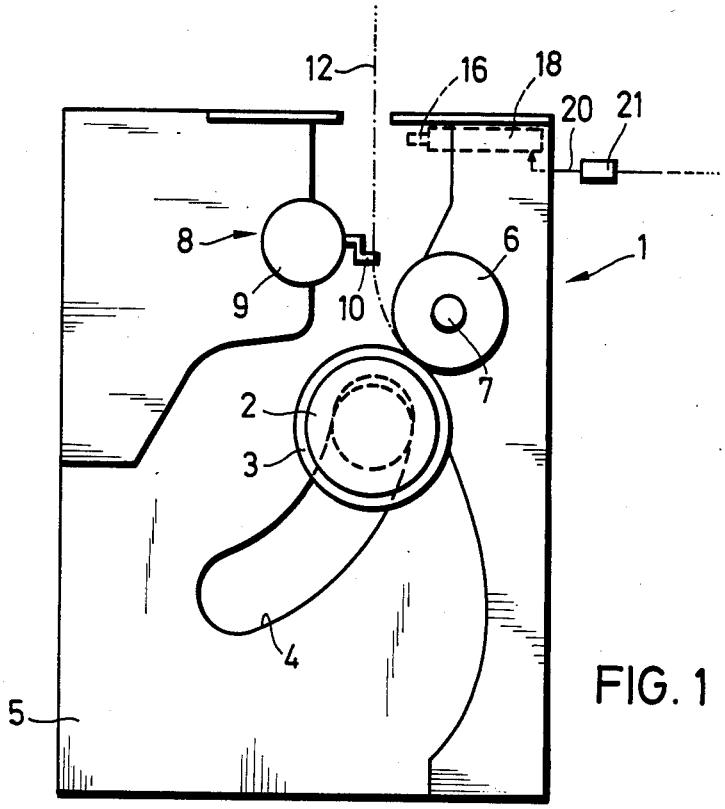
FIG. 1 is a diagrammatic, front elevational view of a device for forming a thread reserve according to the invention.
Figure 2:
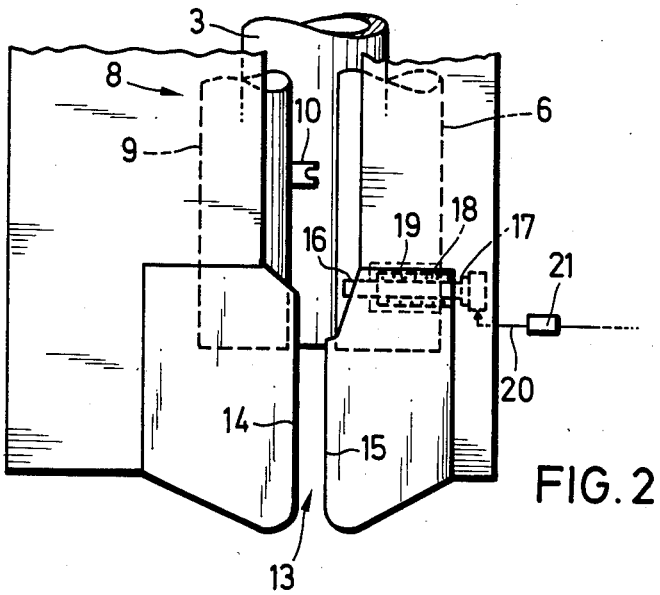
FIG. 2 is a fragmentary, top plan view of the device as shown in FIG. 1.

Spindle winding machine, generally designated 1, is a spindle-driven precision device and includes a spool tube 3 mounted on a spool pin 2 which is advantageously formed as an expanding pin and driven by a motor (not shown). Pin 2 is mounted to pivot on a lever (not shown) along a bow slot 4 located in housing 5 in a well known manner. Pin 2 is urged to move in the direction of pressure roller 6 mounted on shaft 7 to rotate at a fixed location.

In this specific embodiment, a reverse thread roller or changing device, generally designated 8, includes a reversing thread roller 9, is arranged above pin 2 and has a thread guide 10 which moves to-and-fro above tube pin 2. Changing device 8 guides thread 12 constantly to-and-fro when forming the precision thread roll in the longitudinal direction of spool tube 3. A thread reserve is first formed on spool tube 3 by introducing thread 12 into slot 13 formed between guide plates 14 and 15.

A blocking pin 16 is moved into the path of thread 12 for effecting the formation of a thread reserve on spool tube 3. A plunger 17 located at the inner end of blocking pin 16 slides in cylinder 18. Spring 19 disposed in cylinder 18 biasingly engages plunger 17 when a pressure medium is used against the opposing side of plunger 17 to push blocking pin outwardly into the path of thread 12. Pressure medium is fed into cylinder 18 against the plunger 17 via line 20 having a switch 21.

Blocking pin 16 constitutes a projection member movable between an outwardly projecting position and a retracted position. In the outwardly projecting position, blocking pin 16 prevents further shifting of thread 12 in the direction of changing device 8 having thread guide 10. Thread 12 stays in one place so that it is wound up on spool tube 3 at its free end.

Figure 3:
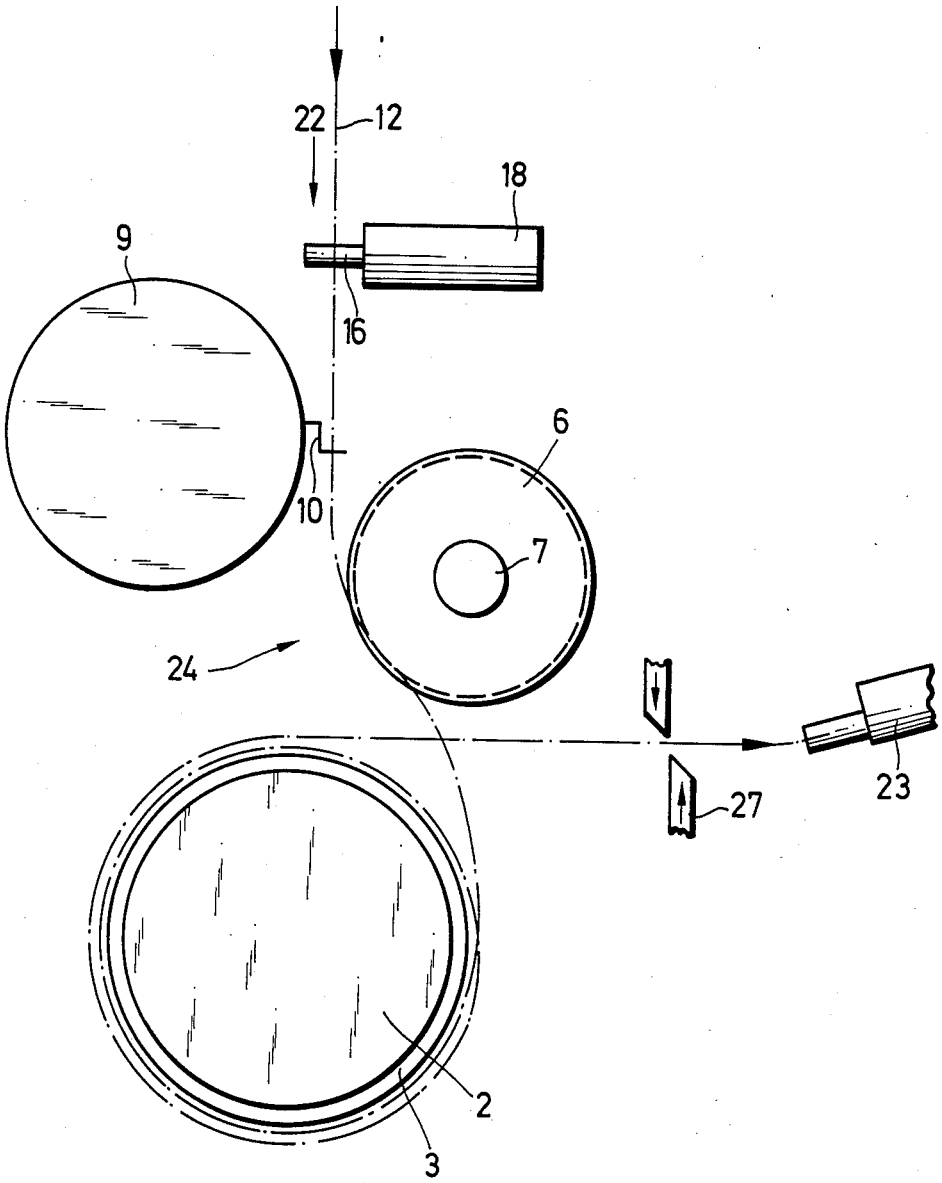
FIG. 3 is a diagrammatic, front elevational view of a device according to the invention showing parts of the assembly used to produce the thread reserve.

As shown in FIG. 3, the course of movement for thread 12 is in a direction (arrow 22) to ultimately wind thread 12 around spool tube 3. An assembly, generally designated 24, guides thread 12 to-and-fro over a length of tube 3 defining the breadth of the thread reserve at a location just ahead of spool tube 3 along the thread course 22 and includes a hand injector 23 or suction pistol used to feed thread 12 therein. Spool tube 3 has a smooth peripheral surface over its whole length.

In this embodiment, assembly 24 constitutes an oblique channel 25 located on the pressure roller 6. Thread 12 is placed into channel 25 which is closed in itself. Blocking pin 16 extends across the opening of slot 13 while thread 12 is moved into channel 25 using hand injector 23. As shown, blocking pin 16 is arranged correspondingly offset in its axial direction with respect to channel 25 as shown in FIG. 4.

Thread 12 continuously shifts laterally over the stretch which emerges as a result of the oblique disposition of channel 25 on pressure roller 6. This lateral shift produces a to-and-fro lateral traveling of thread on spool tube 3 forming the reserve winding as desired. The thread portion lying on top in each case covers the thread turns lying underneath with a corresponding oblique course. Thus, the thread reserve winding holds together at the end of spool tube 3. At the same time, a situation is reached where the reserve winding comes to lie fast on the smooth peripheral surface of spool tube 3 and a relative movement between the reserve winding and the surface of spool tube 3 does not occur.

Cutting device 27 includes two counter acting shearing blades and serves to separate thread 12 from suction pistol 23 as soon as thread 12 is wound a few turns to secure it onto spool tube 3.

Thread reserve formed at the outer end of spool tube 3 is formed when thread 12 is brought into slot 13 using suction pistol 23 while blocking pin 16 is disposed behind slot 13 to catch thread 12 as shown in FIG. 4. Blocking pin 16 remains in that position while thread 12 is guided several times around the rotating smooth, spool tube 3 with the aid of suction pistol 23 as shown at turn 28. Thread 12 thus, enters into oblique channel 25 by thread 12 passing over blocking pin 16 as shown in FIG. 4.

Two or three starting turns of thread 12 about spool tube 3 suffice so that the thread is securely placed to preclude slippage on spool tube 3 having a smooth peripheral surface. Once thread 12 is secured, the end portion of thread 12 leading to suction 23 can be separated with cutting device 27. Thereafter, spool pin 2 with spool tube 3 can be moved gradually to pressure roller 6.

As is evident in FIG. 4, thread 12 is under tension as it approaches blocking pin 16 from a remote point in a plane normal to the longitudinal axis of pressure roller 6. As shown, thread 12 is necessarily under tension as it is pulled past blocking pin 16, through channel 25 onto rotating spool tube 3. Consequently, because of the inherently existing tension therein, a component of that tension causes a tendency for thread 12 to swing toward the center of pressure roller 6 and would do so but for thread 12 being blocked by blocking pin 16.

Immediately after completing the reserve winding, blocking pin 16 is withdrawn to a retracted position away from the path of thread 12. Once withdrawn, blocking pin 16 no longer withholds the thread 12 tendency to swing toward the center of pressure roller 6 and the inherently existing tension therein and the geometry of the thread path, pressure roller 6 and spool pin 2 effect removal of thread 12 from channel 25 and causes thread 12 to swing toward the area of reversing thread roller 9. Once thread 12 now reaches the area of the reversing roller 9, it is gripped by thread guide 10 after, leaving oblique channel 25. The precision winding is set up in a corresponding manner with the changing device 8 driven at the same time by the motor which drives spool pin 2. Pressure roller 6 fixedly mounted on shaft 7 which is freely rotatable lies under pressure against spool tube 3 carried by spool pin 2.

Another embodiment of the device according to the invention is shown in FIG. 5. The thread reserve forming device, generally designated **24*a*, guides spooling thread 12 to-and-fro over the end of spool tube 3. Device 24*a* includes a slide member 30 connected to crank gear 33 via control rod 32 and mounted to slidingly move between guides 31*a* and 31*b*. Slide member 30 carries two pins 34 that are laterally spaced with respect to each other forming a passageway therebetween into which passageway spooling thread 12** runs.

As is evident in FIG. 5 with blocking pin 16 in the position as shown, thread 12 moves past blocking pin 16 through the passageway between pins 34, past pressure roller 6 and winds around rotating spool tube 3 carried by spool pin 2. As in the earlier embodiment of FIG. 4, thread 12 is necessarily under tension with an unavoidable tendency to swing toward the center of pressure roller 6 and the area of reversing thread roller 9. Slide member 30 moves back-and-forth between guides **31*a* and 31*b* over a predetermined stretch as shown by the double-headed arrow along pressure roller 6**.

Such back-and-forth movement carries thread 12 back-and-forth with the pins 34 while blocking pin 16 is in the position as shown. As in the earlier embodiment, once blocking pin 16 is withdrawn, the inherently existing tension and the geometry of the thread path, pins 34, pressure roller 6 and spool pin 2 effect removal of thread 12 from the passageway between pins 34 and causes thread 12 to swing toward the area of reversing thread roller 9. The back-and-forth movement of guide member 30 is effected by rotation of crank gear 33 pivotally connected to control rod 32. The passageway on slide member 30 may be formed in various ways. Crank gear 33 is rotatably mounted to the apparatus so that slide member 30 moves back-and-forth in a direction that is generally parallel to the longitudinal axis of pressure roller 6 as shown.

While the method and assembly for forming a thread reserve on a spool tube in a thread winding apparatus have been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. An assembly for forming a thread reserve winding when spooling a thread onto a rotatably mounted spool tube in a thread winding apparatus, said assembly comprising:

(a) a spool pin, a pressure roller and reverse thread roller device located with respect to each other to form said thread winding apparatus, (b) the spool pin including means for carrying the spool tube; a motor connected to rotate the spool tube, (c) means mounting said spool tube to swing in a direction toward the pressure roller disposed adjacent the spool pin to effect a thread winding function upon operation of the reverse thread roller device, (d) said spool tube including a smooth peripheral surface at least in the area of the thread reserve winding, (e) said pressure roller having a thread entry end; a thread blocking device being disposed at said entry end of the pressure roller for holding back the thread from being introduced to the reverse thread roller device until the thread reserve winding has been wound onto the spool tube, and (f) thread directing means for directing an incoming thread to-and-fro over a length of the spool tube defining the breadth of the thread reserve winding being formed, (g) said thread directing means being located ahead of the spool tube when viewing the assembly in the direction of the course of the thread through the thread winding apparatus, (h) said thread directing means includes an oblique channel located on the reserve roller, (i) said channel being closed in itself.

2. An assembly as defined in claim 1 wherein a thread cutting device is disposed adjacent the thread winding apparatus to separate an end portion of the incoming thread once the thread has been secured on the spool tube.

3. An assembly as defined in claim 2 wherein a housing is disposed around the thread winding apparatus including the assembly for forming a thread reserve winding and the thread cutting device is accommodated within said housing and disposed adjacent the pressure roller.

4. An assembly as defined in claim 1 wherein the thread blocking device includes a projection member movable between an outwardly projecting position and a retracted position, said projection member being effective to hold back the incoming thread when in an outwardly projecting position while the thread reserve winding is being formed.

5. An assembly as defined in claim 4 wherein the thread winding apparatus includes an incoming thread slot defined between guide plates located at the entry end of the pressure roller, and the projection member is a blocking pin member which extends across the incoming thread slot in the outwardly projecting position of the blocking device.

6. An assembly as defined in claim 4 wherein the projection member includes a plunger disposed in a cylinder member, and the thread blocking device includes means to move the plunger back-and-forth within the cylinder.

7. An assembly as defined in claim 6 wherein a spring member urges the plunger in one direction within the cylinder and hydraulic means urge the plunger in the other direction opposite to said one direction within the cylinder.

8. An assembly as defined in claim 1 wherein the thread winding apparatus includes an incoming thread slot defined between guide plates located at the entry end of the pressure roller, and the projection member is a blocking pin member which extends across the incoming thread slot in the outwardly projecting position of the blocking device, the projection member is offset in its axial direction with respect to the oblique channel disposed on the pressure roller.

9. An assembly for forming a thread reserve winding when spooling a thread onto a rotatably mounted spool tube in a thread winding apparatus, said assembly comprising:

(a) a spool pin, a pressure roller and reverse thread roller device located with respect to each other to form said thread winding apparatus, (b) the spool pin including means for carrying the spool tube; a motor connected to rotate the spool tube, (c) means mounting said spool tube to swing in a direction toward the pressure roller disposed adjacent the spool pin to effect a thread winding function upon operation of the reverse thread roller device, (d) said spool tube including a smooth peripheral surface at least in the area of the thread reserve winding, (e) said pressure roller having a thread entry end; a thread blocking device being disposed at said entry end of the pressure roller for holding back the thread from being introduced to the reverse thread roller device until the thread reserve winding has been wound onto the spool tube, and (f) thread directing means for directing an incoming thread to-and-fro over a length of the spool tube defining the breadth of the thread reserve winding being formed, (g) said thread directing means being located ahead of the spool tube when viewing the assembly in the direction of the course of the thread through the thread winding apparatus, (h) said thread directing means including a slide mechanism located adjacent the pressure roller for moving the incoming thread back-and-forth along a delimited length of the pressure roller, (i) the slide mechanism including means for moving a slide member back-and-forth within slide member guiding means, (j) said slide member including thread engaging means which engage the incoming thread while the thread reserve winding is being formed as the slide member moves back-and-forth, (k) the thread engaging means including two pins laterally displaced with respect to each other on the slide member to define therebetween a passageway through which the incoming thread moves from the thread blocking device past the pressure roller onto the spool tube.

10. An assembly as defined in claim 9 wherein the thread blocking device includes a projection member movable between an outwardly projecting position and a retracted position, said projection member being effective to hold back the incoming thread when in an outwardly projecting position while the thread reserve winding is being formed.

11. An assembly as define in claim 10 wherein the thread winding apparatus includes an incoming thread slot defined between guide plates located at the entry end of the pressure roller, and the projection member is a blocking pin member which extends across the incoming thread slot in the outwardly projecting position of the blocking device.

12. An assembly as defined in claim 10 wherein the projection member includes a plunger disposed in a cylinder member, and the thread blocking device includes means to move the plunger back-and-forth within the cylinder.

13. An assembly as defined in defined in claim 12 wherein a spring member urges the plunger in one direction within the cylinder and hydraulic means urge the plunger in the other direction opposite to said one direction within the cylinder.

14. A method for forming a thread reserve when winding a thread onto a spool tube in a thread winding apparatus having a spool pin, pressure roller and a reverse thread roller device, said method comprising the steps of:

(a) providing a spool tube having a smooth peripheral surface at least in the area of the thread reserve winding, (b) rotating the spool tube carried by the spool pin, (c) providing a thread blocking device at an entry end of the pressure roller to hold back the thread from being introduced to the reverse thread roller until the thread reserve winding has been would onto the spool tube, (d) providing a thread directing means for directing an incoming thread to-and-fro over a length of the spool tube defining the breadth of the thread reserve being formed, (e) disposing the thread directing means ahead of the spool tube when viewing the assembly in the directing of the course of the thread through the thread winding apparatus, (f) grasping an end portion of the thread and introducing the incoming thread in front of the thread blocking device and into the thread directing means before the pressure roller is in peripheral contact with the spool tube, (g) allowing the incoming thread to wind around the smooth surface of the rotating spool tube to securely place the thread thereon, (h) cutting the thread to separate the end portion thereof once the thread is secured to the thread reserve length of the spool tube and then allowing the thread to be moved back-and-forth by the thread directing means to form the thread reserve winding on the spool tube, and (i) upon completion of the thread reserve winding, releasing the thread from the thread blocking device to allow the thread to be introduced into the reverse thread roller device.

* * * * *